United States Patent [19]

Johnson et al.

[11] Patent Number: 4,523,795

[45] Date of Patent: Jun. 18, 1985

[54] DISCHARGE LAMP OPERATING APPARATUS AND METHOD

[75] Inventors: Stephen G. Johnson, Georgetown; William M. Labadini, Salisbury, both of Mass.

[73] Assignee: GTE Products Corporation, Stamford, Conn.

[21] Appl. No.: 639,608

[22] Filed: Aug. 10, 1984

Related U.S. Application Data

[63] Continuation of Ser. No. 431,956, Sep. 30, 1982, abandoned.

[51] Int. Cl.[3] ..... H05B 39/00

[52] U.S. Cl. ..... 315/97; 315/107; 315/244

[58] Field of Search ..... 315/97, 101, 244

[56] References Cited

U.S. PATENT DOCUMENTS

| | | | |
|---|---|---|---|
| 3,924,155 | 12/1975 | Vogeli | 315/97 |
| 3,983,449 | 9/1976 | Dear et al. | 315/244 |
| 3,996,495 | 12/1976 | Herman | 315/244 |
| 4,079,292 | 3/1978 | Kaneda | 315/274 |
| 4,119,886 | 10/1978 | Jyomura et al. | 315/101 |
| 4,347,462 | 8/1982 | Adachi | 315/101 |
| 4,360,762 | 11/1982 | Yamamoto et al. | 315/101 |
| 4,370,601 | 1/1983 | Horii et al. | 315/DIG. 2 |

FOREIGN PATENT DOCUMENTS 2066801 7/1981 United Kingdom .

*Primary Examiner*—Harold Dixon

*Attorney, Agent, or Firm*—Thomas H. Buffton

[57] ABSTRACT

A process for operating a discharge lamp with an arc drop of not less than about 75% of a given service voltage includes the steps of series connecting a ballast and discharge lamp, coupling the series connected ballast and discharge lamp to a service voltage source and shunting the discharge lamp with a means for developing a pulse potential at or near the beginning of each half-cycle of the service voltage. Also, a series connected inductive ballast and discharge lamp are connected to a service voltage source and a non-linear dielectric element and preheat switching means each shunting the discharge lamp.

14 Claims, 3 Drawing Figures

DISCHARGE LAMP OPERATING APPARATUS AND METHOD

This application is a continuation of application Ser. No. 431,956, filed Sept. 30, 1982, now abandoned.

TECHNICAL FIELD

This invention relates to apparatus and a method for operating fluorescent discharge lamps and more particularly to apparatus and a method for operating fluorescent discharge lamps such that the voltage drop thereacross is not less than about 75% of the RMS value of an applied service voltage.

BACKGROUND ART

Generally, fluorescent lamps operate from a 50 to 60 hertz alternating current source and emit radiation in the visible region of the spectrum. This visible radiation is provided by an internal phosphor coating or a light transmittable glass envelope which is excited by ultraviolet radiation produced in a low pressure mercury-rare gas vapor discharge operating within the glass envelope. Normally, this vapor discharge has a negative volt-amphere characteristic and the current of such a plasma will tend to continuously increase in magnitude if not restrained by a current limiter or ballast in series connection therewith.

Conventionally, the electrical circuit of a fluorescent lamp system includes a starter, an inductor ballast or combination inductor ballast and step-up transformer and a fluorescent lamp. The ballast and fluorescent lamp are series connected such that the sum of the instantaneous voltage drops across the ballast and the lamp is equal to the applied service voltage. Unfortunately, the three instantaneous voltages may not necessarily be in phase and, as a result, the root means square (RMS) values of the lamp voltage and the ballast voltage may not equal the service voltage. Moreover, experience indicates that the RMS value of the voltage across the typical fluorescent lamp utilizing only an inductive ballast is about one-half or 50% of the rated RMS value of the applied service voltage. Thus, the size or voltage rating of a lamp suitable to ordinary circuitry is seriously limited by the service voltage value and the restrictive one-half or 50% thereof available across the lamp. In other words, lower voltage lamps are usually necessitated because of availability thereacross of only about 50% of the service voltage when applied to the lamp and an inductor ballast combination.

Additionally, it has been found that an increase in potential applied to a fluorescent lamp is particularly effective in increasing light output therefrom. More specifically, potential applied to a fluorescent lamp can be separated into three distinct voltages, i.e. cathode fall voltage, positive column or arc drop votlage and anode fall voltage. Since the cathode and anode fall voltages remain substantially constant for any given lamp geometry, it follows that an increase in voltage applied to the lamp is primarily added to the positive column or arc drop voltage. Moreover, it is this positive column or arc drop voltage which controls the ultraviolet radiation and, in turn, excitation of the lamp phosphors and production of light. Thus, increased voltage available to the fluorescent lamp has a very significant effect upon the percentage increase in light available from the lamp.

One known technique frequently employed to increase the potential available to a discharge lamp is to utilize a step-up transformer and a fixed capacitor. In this manner, an increased potential appearing at the capacitor is available to the series connected inductive ballast and discharge lamp. However, transformers are expensive and cumbersome adding greatly to the apparatus cost while a fixed capacitor must be of increased size in order to provide a voltage of increased magnitude. Moreover, larger size capacitors add to the apparatus cost.

Another known apparatus for improving the operation of a ballast and discharge lamp is suggested in U.S. Pat. No. 3,996,495 issued to Herman on Dec. 7, 1976 and bearing the title "High Efficiency Ballast System For Electric Discharge Lamps". Therein, a non-linear capacitor is connected in series with a conventional high resistance transformer and allegedly improves the lamp current crest factor. Thus, lamp efficiency is reportedly improved because of an improved lamp current crest factor. In this manner, lamp current can be reduced without loss of liquid output. However, starting and maintaining ignition of increased wattage lamps remains a problem.

Another known apparatus suggesting improved starting and operating of fluorescent lamps is proposed in U.S. Pat. No. 4,079,292 issued to Kaneda on Mar. 14, 1978. Therein, an oscillation booster circuit is utilized to provide reignition energy to a discharge lamp in each half cycle of an AC power source. Thus, a relatively small inductor ballast may be utilized in conjunction with a relatively high voltage discharge lamp. However, auxillary booster oscillator circuitry as well as the switching circuitry associated therewith are obvious disadvantages in so far as apparatus cost are concerned.

Additionally, U.K. Pat. No. 2,066,801 A published July 15, 1981 and issued to TDK Electronics Company, Ltd. suggests a non-linear dielectric element, the composition thereof, and a circuit utilizing the device with a lamp and a relatively complex preheating circuit for starting a lamp. Primarily, fabrication of this non-linear dielectric element is discussed and claimed.

OBJECTS AND SUMMARY OF THE INVENTION

An object of the present invention is to provide an enhanced apparatus and method for operating electric discharge lamps. Another object of the invention is to improve the efficiency of a discharge lamp operable from a given service voltage source. Still another object of the invention is to enhance the percentage of the service voltage applied to a discharge lamp. A further object of the invention is to provide a process and apparatus wherein not less than about 75% of the RMS value of an available service voltage is applied to a discharge lamp.

These and other objects, advantages and capabilities are achieved in one aspect of the invention by discharge lamp operating apparatus having an inductive ballast and a discharge lamp coupled to a service voltage source and a non-linear dielectric element and a lamp preheating switch means shunting the discharge lamp whereby the discharge lamp is operated at not less than 75% of the RMS value of the service voltage of the service voltage source.

In another aspect of the invention, a process for operating a discharge lamp is provided wherein an inductive ballast and a discharge lamp are connected in series, the series connected discharge lamp and inductive ballast are connected to a service voltage source, and a non-linear capacitor and a lamp preheating switch means are shunted across the discharge lamp whereby 75% of the RMS value of the service voltage appears across the discharge lamp.

BEST MODE FOR CARRYING OUT THE INVENTION

For a better understanding of the present invention, together with other and further objects, advantages and capabilities thereof, reference is made to the following disclosure and appended claims in conjunction with the accompanying drawings.

Figure 1:
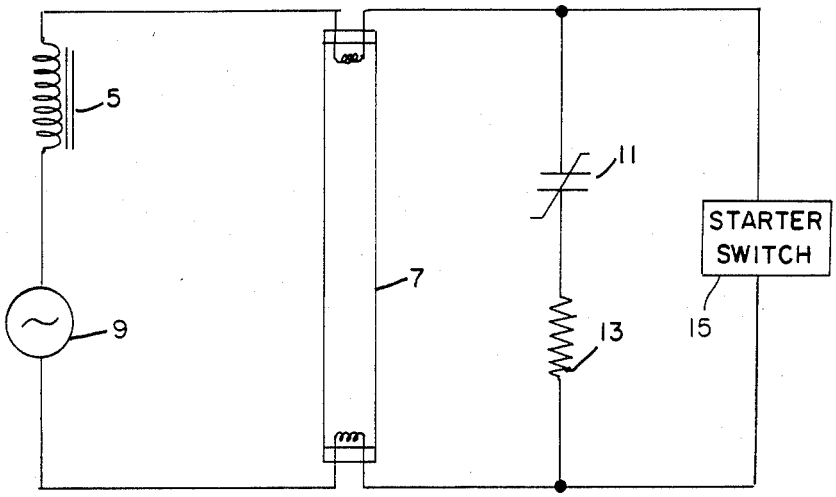
FIG. 1 is a schematic illustration of a preferred apparatus suitable to the operating method of the invention.

Referring to the drawings, apparatus for starting and operating a discharge lamp is illustrated in FIG. 1. Herein, an inductive ballast 5 is in series connection with a discharge lamp which in this instance is illustrated as a pre-heated type low pressure fluorescent lamp 7. A service voltage source 9, such as a 120$^{v}$ AC line voltage for example, is coupled to the series connected ballast 5 and fluorescent lamp 7. Alternatively, a voltage and transformer combination (not shown) may be employed to provide a service voltage 9 for the series connected ballast 5 and discharge lamp 7.

Shunted across the discharge lamp 7 is a non-linear dielectric element, such as a non-linear capacitor 11. This non-linear capacitor 11 serves to provide the initial and reoccurring starting potentials required as will be explained hereinafter. Also, an impedance such as a resistor 13 is preferably connected in series with the non-linear capacitor 11. Moreover, a preheater switch means 15 is shunted across the discharge lamp 7 where filament preheating thereof is deemed appropriate.

As to operation, it is known that the potential drop across a discharge lamp includes a cathode fall, anode fall and an arc drop or positive column. Also, it is known that the cathode and anode fall or voltage drop for any given lamp configuration remains substantially constant. Thus, increased lamp voltage or increased voltage drop across the positive column of a lamp increases the percentage of the applied energy dissipated in the useful production of light. In other words, higher voltage rated lamps operable from a given service voltage source will provide the higher percentage of energy useful in producing light output.

Additionally, it is known that the breakdown voltage or starting voltage of the positive column or plasma of a discharge lamp is inversely related to the electron density within the discharge region. Since the starting voltage per half-cycle is reached at a later time in the voltage waveform and the voltage necessary to maintain ionization ends sooner per half-cycle in a high voltage lamp than in a low voltage lamp, it follows that the duration of ionization for lamps having a higher starting voltage is ordinarily reduced. As a result of this reduced ionization condition, the starting voltage required to establish discharge every half-cycle is greatly increased as the voltage rating of the lamp employed is increased. Thus, most higher voltage lamps used in series with only an inductive type ballast would not initiate nor sustain an operational discharge with a normally applied service voltage.

However, it has been found that the above-mentioned undesired reduction in ionization time and later initiation of starting a higher voltage rated lamp can be obviated by shunting the higher voltage discharge lamp with a non-linear dielectric element, 11 of FIG. 1. In this manner, a pulse voltage is generated at or near the beginning of each half-cycle of the applied service voltage to insure not only starting of the lamp each half-cycle but also provide sufficient free electrons to insure a lower initial starting voltage value each half-cycle of the applied service voltage. Moreover, this reduced starting voltage and increased electron density increases the initial current flow through the discharge lamp while decreasing the maximum current flow through the discharge lamp or decreases the current crest factor. Consequently, discharge lamps having a RMS operating potential of not less than about 75% of the supply voltage, as compared with 50% for known apparatus, can be consistently started and operated when a non-linear dielectric element 11 is employed.

Figure 2:
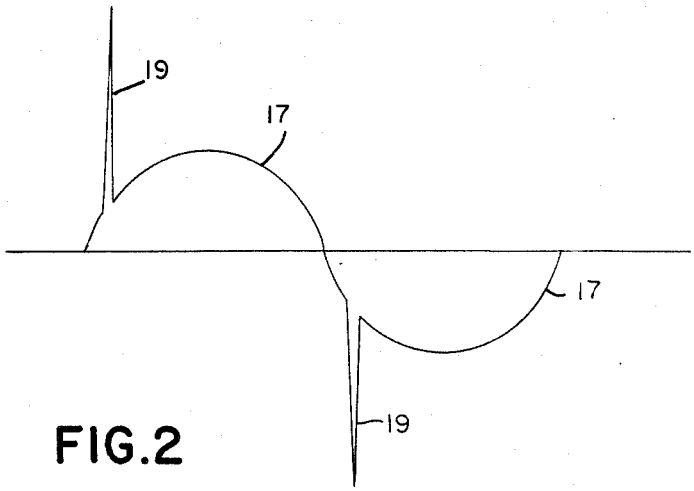
FIG. 2 is a graphic illustration of the operational potentials of the method of FIG. 1.

More specifically, it has been found that no current flows through the discharge lamp 7 during the initial period of the half-cycle. Rather, the current flow during this initial time period is into the non-linear dielectric element 11. Once the non-linear dielectric element 11 becomes fully charged, current ceases to flow through the device and the field of the inductive ballast 5 rapidly collapses producing a high voltage pulse potential, 19 of FIG. 2, at or near the beginning of each half-cycle of the service voltage 17. Thereupon, the high voltage pulse potential 19 initiates conductivity each half cycle in the discharge lamp 7. Moreover, the conductivity of a higher voltage lamp is initiated earlier because of the high voltage pulse potential 19 which reduces the initial starting voltage and increases the ionization period of the discharge lamp 7.

Further, an impedance, such as the resistor 13 of FIG. 1, may be included in series connection with the non-linear capacitor 11 in order to delay the times at which the pulse potential 19 occurs in the cycle of the service voltage 17. In other words, the magnitude of the available sustaining voltage can be increased by delaying the time at which the pulse potential 19 is impressed upon to the service voltage 17.

Also, a preheat switching means 15 is preferably employed when the fluorescent lamp 17 is of the preheating type. For example, the preheat switching means 15 may be in the form of an inductive coil surrounding a heat-responsive bimetal whereupon the bimetal serves to disconnect the switching means 15 upon attainment of a desired temperature of the filament of the discharge lamp 7.

In a specific example, a T-5 type 13-watt fluorescent lamp was connected in series with a copper wound iron core inductor ballast having an inductance value of about 900 mh. In turn, the series connected fluorescent lamp and inductive ballast were coupled to a 120 AC service voltage source having about a 10% voltage variance or varying in the range of about 108 to 132-volts. A non-linear capacitor having a value of about 3.0 nanofarads was connected in series with a resistor in the range of about 1 to 300-ohms, and preheat switching means shunted the discharge lamp. As a result, it was found the pulse potentials in the range of about 1000-volts were readily obtained at each half cycle of the switch voltage whereby operation of the lamp was started and maintained.

Figure 3:
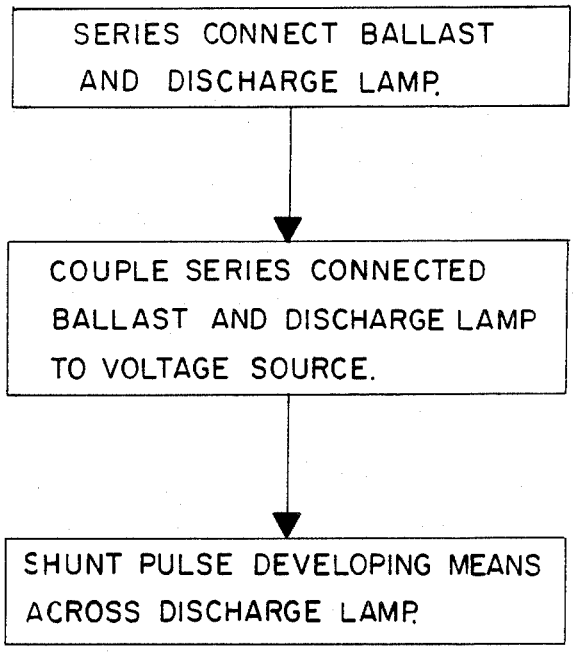
FIG. 3 is a flow chart setting forth a preferred method of operating a discharge lamp in accordance with the invention.

As can be observed in the flow chart of FIG. 3, a preferred method for operating a discharge lamp with an arc drop thereacross of not less than about 75% of an applied service voltage includes the series connecting of an inductive ballast and a fluorescent lamp or discharge lamp, coupling the series connected discharge lamp and inductive ballast to a service voltage source, shunting the discharge lamp with a non-linear dielectric element and also with a preheating switching means. Moreover, a time delaying impedance may be connected in series with the non-linear dielectric element.

As previously mentioned, shunting a discharge lamp with a non-linear dielectric element provides development of a pulse potential at or near the beginning of each half-cycle of a service voltage applied to a series connected inductive ballast and discharge lamp. This developed pulse potential not only provides a potential gradient sufficiently large to enhance ionization and free electrons in the lamp, but also provides a starting voltage whereby conductivity of the discharge lamp starts earlier and is maintained longer which increases the period of ionization and number of electrons available in the discharge lamp. Moreover, the shape and frequency of the current waveform is altered in a manner whereby a larger current flow through the discharge lamp occurs earlier in the half cycle and lasts longer in the half cycle as compared with an inductor ballast alone. Thus, the maximum value of the current waveform is reduced resulting in a highly desirable lower crest factor for the current. As a result, a current waveform more nearly approaching an ideal square-wave configuration is attained and lamp efficiency is enhanced.

Further, lower current higher voltage discharge lamps have a lower current wall loading condition which greatly facilitates improved phosphor maintenance of the discharge lamp. Also, a lower maximum level of current flow permits a reduction in size and weight of an iron core in an inductive ballast which is an obvious advantage in cost and applications wherein size and weight are important.

While there has been shown and described what is at present considered the preferred embodiments of the invention, it will be obvious to those skilled in the art that various changes and modifications may be made therein without departing from the invention as defined by the appended claims.

We claim:

1. Discharge lamp operating apparatus comprising
- a fluorescent lamp having a wattage of about 13 watts;
- inductive ballast means coupled to said fluorescent lamp, said ballast means having an inductive value in the range of about 900 mh;
- service voltage source means in the range of about 108 to 132 volts AC coupled to said inductive ballast means and to said lamp;
- preheat switching means shunting said discharge lamp; and
- a non-linear capacitor of a value in the range of about 3.0 nanofarads shunting said fluorescent lamp for effecting and continuing starting and operation of said fluorescent lamp at not less than about 75% of the RMS voltage of said service voltage source.

2. The discharge lamp operating apparatus of claim 1 including a resistor in the range of about 21 to 300-ohms in series connection with said non-linear capacitor.

3. A method of operating a discharge lamp comprising the steps of series connecting an inductive ballast having an inductive value of about 900 mh. and a fluorescent lamp of a wattage of about 13-watts; coupling said series-connected ballast and fluorescent lamp to a source of AC voltage in the range of about 108 to 132-watts; and shunting said fluorescent lamp with a preheating switch means and with a non-linear capacitor in the range of about 3.0 nanofarads to provide a pulse potential near the beginning of each half-cycle of said AC voltage and a voltage drop across said fluorescent lamp of not less than about 75% of the RMS voltage of said source of AC voltage.

4. The methods of operating a discharge lamp of claim 3 including the step of connecting an impedance in series-connection with said non-linear capacitor to adjust the positional location of a pulse potential each half-cycle of said AC voltage.

5. Discharge lamp starting and operating apparatus comprising:
- a pair of terminals formed for connection to an AC potential source;
- an inductive ballast connected to one of said pair of terminals;
- a non-linear dielectric element means connected to said inductive ballast and to the other one of said pair of terminals; and
- a discharge lamp connected in shunting relationship to said non-linear dielectric element, said discharge lamp having an rms operating voltage of not less than about 75% of the rms voltage of said AC potential source whereby the increase in energy dissipated in said discharge lamp is converted into useful light output from said discharge lamp.

6. The discharge lamp starting and operating apparatus of claim 5 including a preheat switching means shunting said discharge lamp whereby said discharge lamp is preheated prior to a desired filament temperature and disconnected upon attainment of said temperature.

7. The discharge lamp operation apparatus of claim 5 including an impedance in series connection with said non-linear dielectric element means and shunting said discharge lamp.

8. The discharge lamp operating apparatus of claim 5 wherein said dielectric element means shunting said discharge lamp is in the form of a non-linear capacitor.

9. The discharge lamp operating apparatus of claim 5 wherein said AC potential source provides an AC voltage in the range of about 108 to 132-volts, said inductive ballast means has an inductive value of about 900 mh, said non-linear dielectric element means is a non-linear capacitor of about 3.0 Nanofarads and said discharge lamp is a fluorescent lamp of about 13-watts.

10. The discharge lamp operation apparatus of claim 9 including a resistor of a value in the range of about 1 to 300 ohms in series connection with said non-linear dielectric element means.

11. A method for operating a fluorescent discharge lamp comprising the steps of
- coupling a pair of terminals to an AC potential source;
- connecting an inductive ballast to one of said pair of terminals;

connecting a non-linear dielectric element to said inductive ballast and to the other one of said pair of terminals; and shunting a discharge lamp across said non-linear dielectric element, said lamp having an rms operating voltage of not less than about 75% of the rms voltage of said AC potential source.

12. The method of claim 11 including the step of connecting an impedance in series with non-linear capacitor whereby positional location of said pulse potential each half cycle of said AC service voltage is altered.

13. The method of claim 11 wherein said discharge lamp is a 13-watt fluorescent lamp said non-linear capacitor is about 3.0 Nanofarads and said service voltage source is in the range of about 108 to 132 volts.

14. The method of claim 11 wherein said inductive ballast is of a value of about 900 mh, said discharge lamp is a 13 watt fluorescent lamp and said service voltage source provides an AC voltage in the range of about 108 to 132 volts whereby a voltage drop across said fluorescent lamp of not less than about 75% of the RMS voltage of said service voltage source is effected.

* * * * *